US005351958A

United States Patent [19]

Helmstetter

[11] Patent Number: 5,351,958

[45] Date of Patent: Oct. 4, 1994

[54] PARTICLE RETENTION IN GOLF CLUB METAL WOOD HEAD

[75] Inventor: Richard C. Helmstetter, Carlsbad, Calif.

[73] Assignee: Callaway Golf Company, Carlsbad, Calif.

[21] Appl. No.: 112,123

[22] Filed: Aug. 26, 1993

Related U.S. Application Data

[63] Continuation-in-part of Ser. No. 29,553, Mar. 11, 1993, Pat. No. 5,301,945, which is a continuation of Ser. No. 819,379, Jan. 15, 1992, Pat. No. 5,240,252, which is a continuation-in-part of Ser. No. 791,322, Nov. 14, 1991, Pat. No. 5,180,166, which is a continuation of Ser. No. 595,963, Oct. 16, 1990, Pat. No. 5,067,715.

[51] Int. Cl.[5] ..... A63B 53/04

[52] U.S. Cl. ..... 273/167 H; 273/173

[58] Field of Search ..... 273/78, 167 R, 169–175, 273/167 A–167 K, 77 A

[56] References Cited

U.S. PATENT DOCUMENTS

| | | | |
|---|---|---|---|
| 3,356,782 | 12/1967 | Whyte . | |
| 3,800,914 | 4/1974 | Miyata . | |
| 3,810,621 | 5/1974 | Mils | 273/80.2 |
| 3,869,391 | 3/1975 | Kramer . | |
| 4,067,572 | 1/1978 | Coleman . | |
| 4,214,754 | 7/1980 | Zebeleah | 273/167 H |
| 4,220,336 | 9/1980 | Kochevar | 273/169 |
| 4,355,808 | 10/1982 | Jernigan et al. . | |
| 4,502,687 | 3/1985 | Kochevar . | |
| 4,803,023 | 2/1989 | Enomoto et al. . | |
| 4,811,949 | 3/1989 | Kobayashi . | |
| 4,828,266 | 5/1989 | Tunstall . | |
| 4,944,515 | 7/1990 | Shearer . | |
| 5,009,425 | 4/1991 | Okumoto et al. . | |
| 5,042,806 | 8/1991 | Helmstetter . | |
| 5,064,197 | 11/1991 | Eddy | 273/167 H |
| 5,067,715 | 11/1991 | Schmidt et al. . | |
| 5,180,166 | 1/1993 | Schmidt et al. . | |

OTHER PUBLICATIONS

Magnatac 2663 Material Safety Data Sheet, Beacon Chemical, pp. 1–3, Apr. 26, 1993.

*Primary Examiner*—Vincent Millin
*Assistant Examiner*—Steven B. Wong
*Attorney, Agent, or Firm*—William W. Haefliger

[57] ABSTRACT

A golf club head comprising a bottom shell defining a hollow interior and having a hosel, and walls defining a ball striking front face, a toe and a heel; and a particle or piece getter within the interior and adherent to at least one of the walls; the getter comprising a substance presenting to the hollow interior a surface which remains tacky during use of the club head to strike golf balls, thereby to capture pieces or particles therein by adherence to the surface.

17 Claims, 2 Drawing Sheets

FIG. 1.
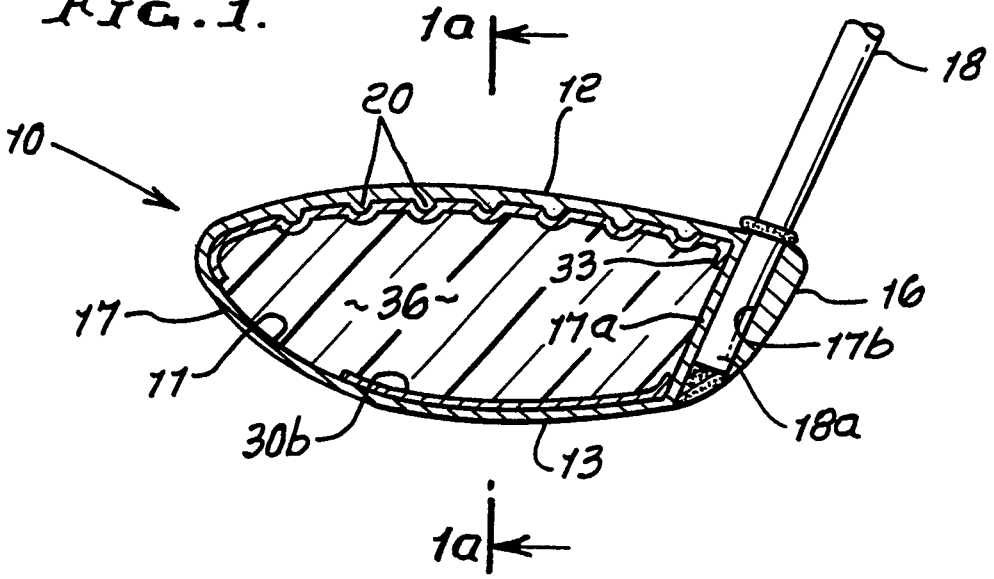
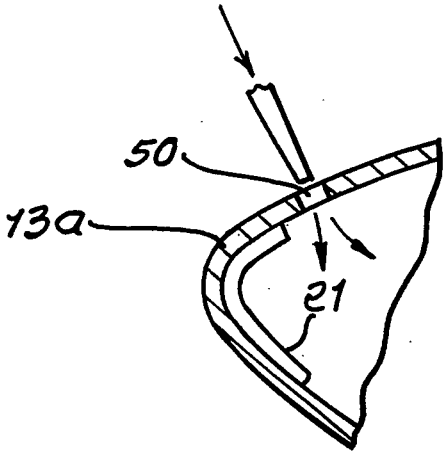
FIG. 5.
FIG. 6.
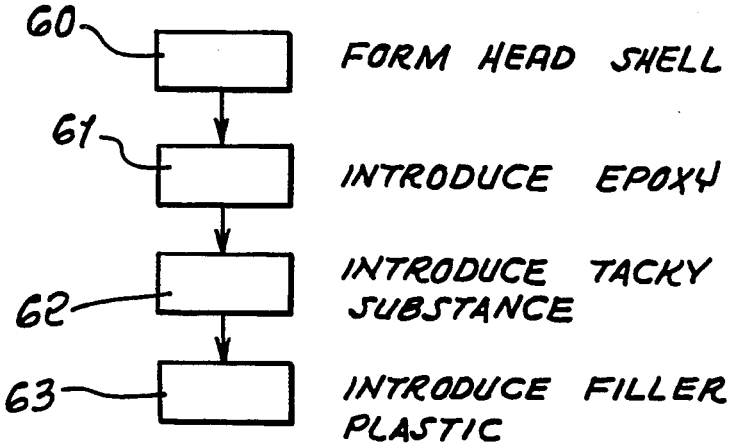

PARTICLE RETENTION IN GOLF CLUB METAL WOOD HEAD

BACKGROUND OF THE INVENTION

This application is a continuation in part of Ser. No. 08/029,553 filed Mar. 11, 1993, now U.S. Pat. No. 5,301,945, which is a continuation of Ser. No. 07/819,379 filed Jan. 15, 1992, now U.S. Pat. No. 5,240,252 which is a continuation-in-part of Ser. No. 07/791,322 filed Nov. 14, 1991, now U.S. Pat. No. 5,180,166, which is a continuation of Ser. No. 07/595,963 filed Oct. 16, 1990, now U.S. Pat. No. 5,067,715.

This invention relates generally to improvements in golf clubs and their manufacture, and more particularly concerns prevention of rattling of golf club hollow metal wood heads in use.

The problem of rattling of hollow, metal wood heads is persistent. Such rattling occurs, for example, due to movement of particles within the head hollow, to impact interior surfaces of the head metal walls, creating audible noise during head rapid movement, as during club swinging. The particles may, for example, comprise small, metal pieces, or plastic pieces, as when the head interior is partially or totally initially filled with lightweight, plastic material in order to prevent head "ringing" when a golf ball is struck, the small pieces separating in use. Also, the plastic filler may break up into relatively large pieces or chunks after a period of use of the clubs, due to forces generated at head impact with a golf ball during club swinging. Such chunks can move about to create objectionable rattle.

There is great need for effective means to stop or prevent such noisy rattle in hollow interior metal wood heads.

SUMMARY OF THE INVENTION

It is a major object of the invention to provide means and method which meets the above need, and which is simple and effective in use and application to a metal wood head. Basically, the invention is embodied in a metal wood head comprising:

a) a bottom shell defining a hollow interior and having a hosel, and walls defining a ball striking front face, a toe and a heel, b) and a particle or piece getter within the interior and adherent to at least one of the walls, c) the getter comprising a substance presenting to the hollow interior a surface which remains tacky during use of the club head to strike golf balls, thereby to capture pieces or particles therein by adherence to the tacky surface.

Another object is to provide the tacky getter substance in a layer extending adjacent one or more walls; and a further object is to provide the tacky substance as a layer extending over dendritic head wall structure, and/or hosel structure, within the head interior, so as to enhance exposure of the tacky substance to particles moving in the head interior.

Yet another object is to provide for enhanced adherence of the getter substance to the head interior wall or walls, as via an epoxy or other adhesive interposed between the getter and the head wall.

A further object is to provide for exposure of the tacky getter to particles, such as pieces of plastic filler in the head, preventing their rattling in the head.

An additional object is to provide a method to form the improved head, which includes the steps:

a) introducing a particle getter into the hollow interior, b) adhering the getter to at least one of the walls, while allowing the getter to present to the hollow interior a surface which remains tacky to capture particles within the hollow interior by adherence to the tacky surface.

In this regard, an opening may be provided in the shell, and the getter introduced in fluid state into the hollow interior. Further, an adhesive may be initially provided in the hollow interior to coat the one wall, and thereafter the getter is introduced into the hollow interior via that opening to contact the adhesive and attach to the one wall by curing of the adhesive. The opening is then sealed.

These and other objects and advantages of the invention, as well as the details of an illustrative embodiment, will be more fully understood from the following specification and drawings, in which:

DRAWING DESCRIPTION

FIG. 1 is a view showing a golf club head in section and incorporating the invention;

FIG. 1*a* is a section taken on lines 1*a*—1*a* of FIG. 1;

FIG. 5 is a view of an inverted head, as seen in FIG. 1*a,* with tacky substance being introduced via an opening into the head interior; and FIG. 6 is a block diagram showing steps in the formation of the club head of the invention.

DETAILED DESCRIPTION

Figure 1A:
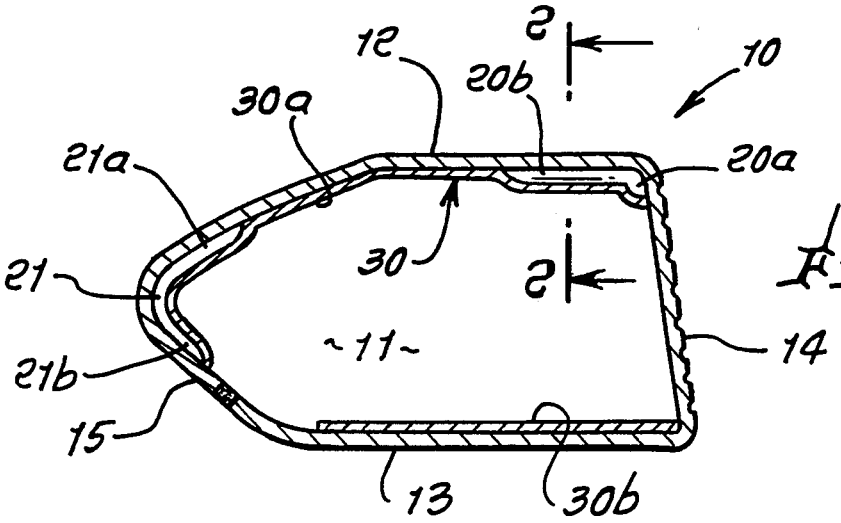

In FIGS. 1 and 1*a,* a golf club head 10 is shown in the form of a metal wood having a hollow interior 11. The head thin-walled, metal shell includes top and bottom walls 12 and 13, a ball striking front wall 14, a rear wall 15, heel 16 and toe 17, and hosel 17*a* located interiorly of the shell, adjacent the heel. The hosel contains a bore 17*b* in which the lower end extent 18*a* of a shaft 18 is received, for adhesive and/or mechanical attachment to the bore 17*a.* See for example the head construction in U.S. Pat. No. 5,042,806 to Helmstetter, the disclosure of which is incorporated herein by reference.

The head shell may also incorporate dendritic structure, including narrow dendrites 20 integral with top wall 12 and projecting downwardly toward and into the head interior 11, those dendrites extending rearwardly from locations 20*a* adjacent the front wall 14, to locations 20*b* above the mid-portion of the hollow interior 11.

Additional narrow dendrites 21 may be provided at the rearwardmost extent of the shell, i.e., inwardly of rear wall 15, to follow the concave interior curvature thereof, as shown. Dendrites 21 extend downwardly and rearwardly at 21*a,* and downwardly and forwardly at 21*b,* to reinforce the curvature of rear wall 15, and are spaced apart in the heel-to-toe direction. All dendrites are formed integrally with the shell and are therefore metallic. See the disclosure of U.S. Pat. No.

5,067,715 to Schmidt et al. incorporated herein by reference.

In accordance with the invention, a particle or piece getter is provided within the shell interior, and is adherent to at least one of the shell walls. The getter comprises a substance or composition presenting to the hollow interior an extended surface or surfaces remaining tacky during use of the golf club, whereby loose particles or pieces moving about within the hollow 11 are captured by adherence to the getter substance surface, so as not to loosely rattle.

Figure 2:
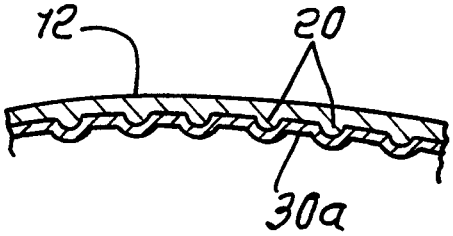
FIG. 2 is a fragmentary section taken on lines 2—2 of FIG. 1*a;*

In the illustration, the getter substance extends as a layer 30 over at least one shell wall, as for example at 30*a* on top wall 12, and at 30*b* on bottom wall 13. The getter may extend over and between the dendrites, as shown. Casting interior surface irregularities of the walls and/or dendrites aid adherence of the getter substance to those surfaces, and the dendrites, as integrally cast, may be regarded as larger form of irregularities, in this regard. Much smaller irregularities may be formed during casting in the surfaces between the dendrites, as well as on the dendrites (if dendrites are employed). Dendrites add to the strength of the thin walls, as disclosed in U.S. Pat. No. 5,067,715, and also aid in stabilized locating of the getter substance extending as a layer, as for example is seen at 30*a* in FIG. 2. Also, the tacky getter may extend on or over, as at 33, surface extent of the hosel 17*a* located within the shell, as seen in FIG. 1, adding to stabilized locating of the getter.

Figure 3:
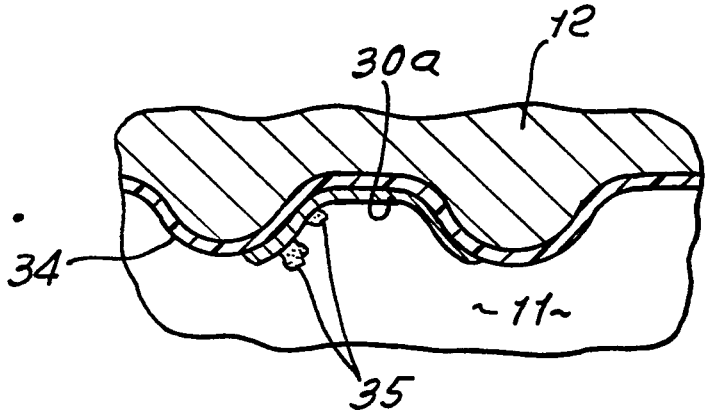
FIG. 3 is an enlarged view of a portion of FIG. 1, to show detail, with particles clinging to the tacky substance.

FIG. 3 shows the provision of an adhesive, such as an epoxy layer 34, between the getter substance 30*a* and the wall 12 of the head. The epoxy layer may extend over one or more of the interior wall surfaces, to bond the tacky substance to such surfaces. Pieces or particles are seen at 35 adherent to the tacky layer 30*a* in FIG. 3, and also in FIG. 2.

Figure 4:
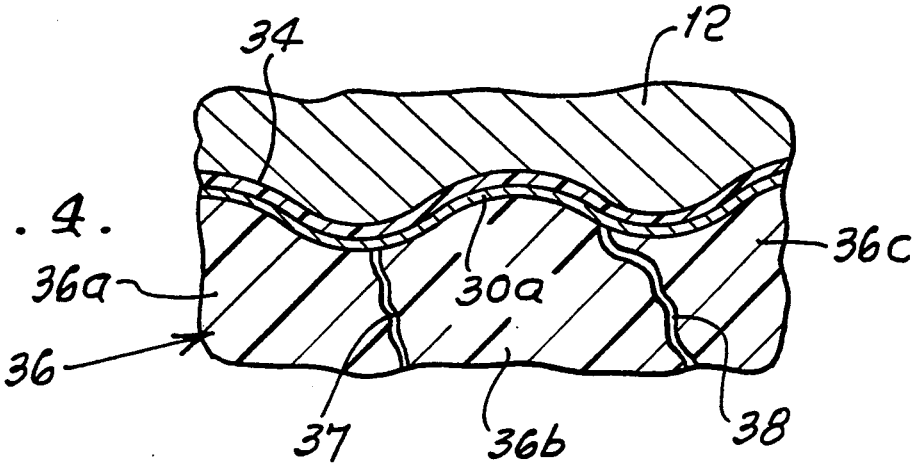
FIG. 4 is a view like FIG. 3 but showing a modification including cracked pieces of synthetic resin in the head and adherent to the tacky substance.

FIG. 4 is like FIG. 3 but shows filler plastic material 36 in the head interior, for filling the latter to prevent audible ringing of the head metal when a ball is struck. Cracks in the filler appear at 37 and 38, or sometimes form during use, due to impact and reaction forces. The getter layer 30*a* adhering to wall 12 attaches to the filler pieces 36*a*, 36*b* and 36*c* separated by the cracks, to inhibit rattling thereof in the head, as when a ball is struck.

Various known getter compositions may be used, and merely as illustrative, the following composition may be employed: polybutene (about 9% by weight), polyisobutylene (about 64% by weight), mineral oil (about 6% by weight), beeswax (about 7% by weight), and petroleum hydrocarbon resin (about 14% by weight), the components thoroughly mixed. Another usable material is the product known as "Magnatac 2663", produced by Beacon Chemical Co., Inc., Mount Vernon, N.Y. 10550, which essentially consists of three components, namely: synthetic resin, elastomer and a heavy, viscous liquid in the nature of a syrup, the mixture defining a pressure-sensitive adhesive base and being soft and tacky. It is a synthetic, organic, rubber/resin, pressure sensitive adhesive.

FIG. 5 shows a method of applying (as by injecting) the getter composition, as via an opening 50 in the head lower wall extent 13*a*, the head being inverted relative to FIG. 1. Prior to that step, epoxy adhesive may be injected via the same opening, and before the epoxy cures in situ adjacent the head interior wall or walls, the getter is injected. The getter need not coat all of the walls where the epoxy extends, but since the epoxy is widely distributed, localized getter will be adhered to the wall via the epoxy at that location. See FIG. 3 as an example. After completion of the getter introduction, the opening 50 may be closed, as by welding.

The steps of the method appear at 60–63 in FIG. 6.

I claim:

1. In a golf club head, the combination comprising:

a) a hollow shell defining a hollow interior and having a hosel, and walls defining s ball striking front face, a toe and a heel, b) a particle or piece getter within said interior, c) said greater comprising a substance presenting to the hollow interior a surface which remains tacky during use of the club head to strike golf balls, thereby to capture pieces or particles therein by adherence to said surface, d) and an adhesive consisting essentially of epoxy extending between said substance and said walls and adherent thereto, the getter being everywhere in the form of a thin layer in said shell and adherent to said adhesive on said walls.

2. The combination of claim 1 wherein said substance extends as a layer adjacent said at least one wall.

3. The combination of claim 1 wherein said substance extends as a layer adjacent at least two of said walls.

4. The combination of claim 1 wherein said substance extends as a layer adjacent all of said walls.

5. The combination of claim I wherein said hosel extends substantially entirely within said interior and is exposed to said getter.

6. The combination of claim 5 wherein said getter is adherent to said hosel within said interior.

7. The combination of claim 5 including dendritic structure integral with said shell and presented toward said hollow interior, and toward said getter.

8. The combination of claim 7 wherein said getter is at least in part adherent to said dendritic structure.

9. The combination of claim 1 including said pieces which comprise plastic filler in the head interior.

10. The combination of claim 1 wherein said getter consists of a mixture of at least two of the follow components:

i) polybutene
ii) polyisobutylene
iii) mineral oil
iv) beeswax
v) petroleum hydrocarbon resin.

11. The combination of claim 10 wherein the getter consists of all of said components, which are present in the follow relative amounts, by weight:

i) about 9%
ii) about 64%
iii) about 6%
iv) about 7%
v) about 14%.

12. In the method of collecting free particles within a golf club head including a shell defining a hollow interior and having a hosel, and walls defining a ball striking front face, a toe and a heel, the steps that include:

a) introducing first an adhesive and then a particle getter into said hollow interior in spaced relation to the hosel so that the getter forms a thin layer on the adhesive substantially everywhere on said walls, said adhesive and getter having different compositions, b) adhering said getter to at least one of said walls, by curing of said adhesive, while allowing said getter to present to said hollow interior a surface which remains tacky to capture particles within said hollow interior by adherence to said tacky surface.

13. The method of claim 12 including providing an opening in said shell, and introducing said adhesive and getter in fluid state into said hollow interior, and closing said opening.

14. The method of claim 13 wherein said adhesive consists essentially of epoxy.

15. The method of claim 12 including providing said shell to have dendritic structure protruding within and toward said hollow interior, and adhering at least some of said getter to said protruding dendritic structure.

16. The method of claim 12 wherein said getter consists of a mixture of at least two of the following components:

i) polybutene
ii) polyisobutylene
iii) mineral oil
iv) beeswax
v) petroleum hydrocarbon resin.

17. The method of claim 16 wherein the getter consists of all of said components, which are present in the following relative amounts, by weight:

i ) about 9%
ii) about 64%
iii) about 6%
iv ) about 7%
v) about 14%.

* * * * *